US010677547B2

(12) United States Patent
Cox

(10) Patent No.: US 10,677,547 B2
(45) Date of Patent: Jun. 9, 2020

(54) PUMP ACTION FIREARM WITH SLIDE LOCK MECHANISM

(71) Applicant: Sturm, Ruger & Company, Inc., Southport, CT (US)

(72) Inventor: George A. Cox, Eden, NC (US)

(73) Assignee: STURM, RUGER & COMPANY, INC., Southport, CT (US)

( * ) Notice: Subject to any disclaimer, the term of this patent is extended or adjusted under 35 U.S.C. 154(b) by 0 days.

(21) Appl. No.: 16/242,455

(22) Filed: Jan. 8, 2019

(65) Prior Publication Data

US 2019/0212081 A1 Jul. 11, 2019

Related U.S. Application Data

(60) Provisional application No. 62/615,100, filed on Jan. 9, 2018.

(51) Int. Cl.

| | |
|---|---|
| ***F41A 3/56*** | (2006.01) |
| ***F41C 7/02*** | (2006.01) |
| ***F41A 3/40*** | (2006.01) |
| ***F41A 3/42*** | (2006.01) |

(52) U.S. Cl.

CPC ..... *F41A 3/56* (2013.01); *F41A 3/40* (2013.01); *F41A 3/42* (2013.01); *F41C 7/02* (2013.01)

(58) Field of Classification Search

CPC ..... F41A 3/36; F41A 3/38; F41A 3/40; F41A 3/42; F41A 3/54; F41A 3/56; F41C 7/02

USPC ..... 89/180, 187.01, 190

See application file for complete search history.

(56) References Cited

U.S. PATENT DOCUMENTS

| | | | | |
|---|---|---|---|---|
| 1,655,446 | A | 1/1928 | Von Frommer | |
| 2,259,989 | A | 10/1941 | Barnes | |
| 2,418,946 | A * | 4/1947 | Loomis | F41A 3/40 89/164 |
| 2,570,772 | A | 10/1951 | Crittendon et al. | |
| 2,601,808 | A * | 7/1952 | Clarke | F41A 3/40 89/190 |
| 2,645,873 | A | 7/1953 | Crittendon et al. | |
| 2,861,374 | A | 11/1958 | Hampton | |
| 2,901,853 | A | 9/1959 | Fontvieille | |

(Continued)

OTHER PUBLICATIONS

Search Report and Written Opinion from PCT/US2019/12666 dated Mar. 29, 2019, pp. 1-11.

*Primary Examiner* — Bret Hayes

(74) *Attorney, Agent, or Firm* — The Belles Group, P.C.

(57) ABSTRACT

A pump action firearm with bolt slide locking mechanism includes a receiver, a barrel assembly coupled by the receiver, and a bolt slide slideably disposed in the receiver for movement between rearward open breech and forward closed breech positions. A slide lock pivotably mounted to the bolt slide about a pivot axis is selectively engageable with an interference surface on the receiver. When the firearm is fired via a trigger pull, a rotatable hammer strikes and actuates the slide lock. The slide lock rotates from a locked position engaged with the interference surface to prevent the slide from moving out of the closed breech position, to an unlocked position disengaging the interference surface. This allows the slide to be manually moved to the open breech position for cycling the action. A manual actuator is provided for unlocking the slide lock absent a trigger pull.

26 Claims, 15 Drawing Sheets

(56) References Cited

U.S. PATENT DOCUMENTS

| | | | | |
|---|---|---|---|---|
| 3,866,344 | A * | 2/1975 | Kawamura | F41A 3/40 42/16 |
| 4,161,836 | A * | 7/1979 | Hayashi | F41A 3/40 42/16 |
| 4,166,409 | A * | 9/1979 | Gevers | F41A 21/482 89/128 |
| 4,194,433 | A | 3/1980 | Zellweger et al. | |
| 4,344,246 | A | 8/1982 | Bauman et al. | |
| 4,742,634 | A | 5/1988 | Swenson | |
| 5,983,549 | A * | 11/1999 | Battaglia | F41A 3/82 42/17 |
| 6,347,569 | B1 | 2/2002 | Butler | |
| 7,107,715 | B2 | 9/2006 | Keeney et al. | |
| 7,707,923 | B2 | 5/2010 | Beretta | |
| 7,878,107 | B2 | 2/2011 | Moretti | |
| 8,701,324 | B1 | 4/2014 | Viani | |
| 8,800,422 | B2 | 8/2014 | Norton et al. | |
| 9,347,737 | B2 | 5/2016 | Troy et al. | |
| 9,417,019 | B2 | 8/2016 | Norton | |
| 9,448,019 | B2 | 9/2016 | Kokinis et al. | |
| 9,599,419 | B2 | 3/2017 | McGinty | |
| 2009/0101000 | A1 | 4/2009 | Rawson-Harris | |
| 2010/0313459 | A1 | 12/2010 | Gomez | |
| 2015/0330727 | A1 * | 11/2015 | Kolev | F41A 3/12 42/16 |
| 2016/0252316 | A1 | 9/2016 | Garrow | |

* cited by examiner

PUMP ACTION FIREARM WITH SLIDE LOCK MECHANISM

CROSS-REFERENCE TO RELATED APPLICATIONS

The present application claims of the benefit of U.S. Provisional Application No. 62/615,100 filed Jan. 9, 2018; the entirety of which is incorporated herein by reference.

BACKGROUND

The present invention generally relates to slide or pump action firearms, and more particularly to pump action mechanisms and associated bolt slide locks for such firearms.

Conventional AR-type rifles fire from a closed locked breech in which the bolt is locked in axial position to the receiver or barrel assembly before firing. The bolt carrier or slide that carries the bolt, however, is free to move axially to a certain degree. Normally, the recoil spring holds the breech closed, but on a pump action firearm, the bolt carrier is rigidly coupled with a slideable pump handle of some type mounted on the stock forend which is used to cycle the action. The forces of grasping the pump handle can often pull the bolt out of battery unintentionally and cause an operating malfunction. A lock for the bolt carrier is needed for pump action rifles to prevent this situation. The lock mechanism needs to be active until firing, at which point the lock must release the bolt carrier to manually cycle the action for extracting and ejecting the spent shell casing, and chambering a new round from the magazine. A manual release of some type is also needed to manually unload the chamber. Previous slide locks are sometimes mounted in the lower receiver of an AR-type rifle along with the trigger-operated firing mechanism, which can complicate construction and assembly of the firearm.

Improvements in pump action mechanisms and associated bolt slide locks is desired.

SUMMARY

Embodiments of the present invention provide a slide lock mechanism for a manually-operated pump action of a firearm and method for operating the same. The firearm may be an AR-type rifle including a separate upper receiver and a lower receiver which may be pivotably mounted to the upper receiver in typical AR fashion. The present slide lock may be operably disposed in the upper receiver, thereby advantageously conserving precious space in the lower receiver for mounting the trigger-operated firing mechanism and ammunition feed related components including the trigger and magazine assemblies. This also provides a mechanically simpler and efficient arrangement of firearm components that is easy to assemble and disassemble for maintenance.

In one embodiment, the slide lock mechanism may be pivotably mounted on the bolt slide and cooperates with an interference surface on the upper receiver for locking the slide in a forward closed breech position. The bolt slide lock may further be arranged to cooperate and interface with the spring-biased hammer of the firing mechanism for automatically unlocking the slide lock after firing, thereby allowing the slide to cycle rearward under recoil when discharging the firearm to open the breech for extracting/ejecting a spent cartridge casing and chambering a new round in the barrel. The slide lock according to the present disclosure may further be configured to allow manual operation by a user to unlock the slide for opening the breech and removing a cartridge from the chamber of the barrel. To that end, a manual slide lock actuator pivotably mounted the receiver about a separate pivot pin/axis than the slide lock is provided which acts directly on the slide lock as further described herein.

The present disclosure further provides a pump mechanism for manually cycling the bolt slide between the forward closed breech and the rearward open breech position. The pump mechanism advantageously does not require coupling of a movable component directly to the barrel for operating the bolt slide. Instead, the pump mechanism includes a specially configured interface with the handguard which slideably couples a pump handle to the handguard, and in turn to the slide via a mechanical linkage as further described herein.

In one aspect, a pump action firearm with bolt slide locking mechanism comprises: a longitudinal axis; a receiver defining a longitudinal cavity; a barrel assembly coupled to the receiver; a bolt slide slideably disposed in the longitudinal cavity of the receiver, the bolt slide movable between a rearward open breech position and a forward closed breech position in battery with the barrel assembly; and a slide lock pivotably mounted to the bolt slide about a pivot axis and selectively engageable with an interference surface on the receiver, the slide lock pivotably movable between a locked position engaging the interference surface to prevent the slide from moving out of the closed breech position, and an unlocked position disengaging the interference surface to allow the slide to move out of the closed breech position to the open breech position.

In another aspect, a pump action firearm with bolt slide lock mechanism comprises: a longitudinal axis; a receiver comprising a trigger-actuated firing mechanism including a rotatable hammer movable along a firing axis between a rear cocked position and a forward firing position; a barrel assembly coupled to the receiver; a pump handle slideably disposed about the barrel assembly; a bolt slide slideably disposed in the receiver, the bolt slide coupled to the pump handle and movable between a rearward open breech position and a forward closed breech position in battery with the barrel assembly via moving the pump handle; a slide lock pivotably mounted to the bolt slide about a pivot axis laterally offset from the firing axis of the hammer; the slide lock comprising a laterally elongated body including an operating end selectively engageable with an interference surface of the receiver, and an opposite actuation end arranged to engage the hammer; wherein the slide lock is pivotably movable between a locked position in which the operating end engages the interference surface to prevent the slide from moving out of the closed breech position, and an unlocked position disengaging the interference surface to allow the slide to move out of the closed breech position to the open breech position.

According to another aspect, a method for operating an action of a firearm is provided. The method comprises: providing a firearm comprising a longitudinal axis, a receiver, a barrel assembly coupled to the receiver, a hammer pivotably mounted in the receiver, a bolt slide slideably disposed in the receiver for movement between a rearward open breech position and a forward closed breech position in battery with the barrel assembly, and a slide lock pivotably mounted to the bolt slide about a pivot axis; engaging an interference surface arranged on the receiver with the slide lock to hold the bolt slide in the closed breech position; releasing the hammer from a rear cocked position to a forward firing position along a firing axis; striking the slide lock with the hammer to rotate the slide lock about its pivot axis; disengaging the slide lock from the interference surface of the receiver; and moving the bolt slide rearward to the open breech position. In one embodiment, the pivot axis of the slide lock is laterally offset from the firing axis of the hammer. The step of moving the bolt slide rearward may include manually moving a pump handle on the firearm coupled to the bolt slide rearward to open the breech.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The features of the preferred embodiments will be described with reference to the following drawings where like elements are labeled similarly, and in which.

Figure 1:
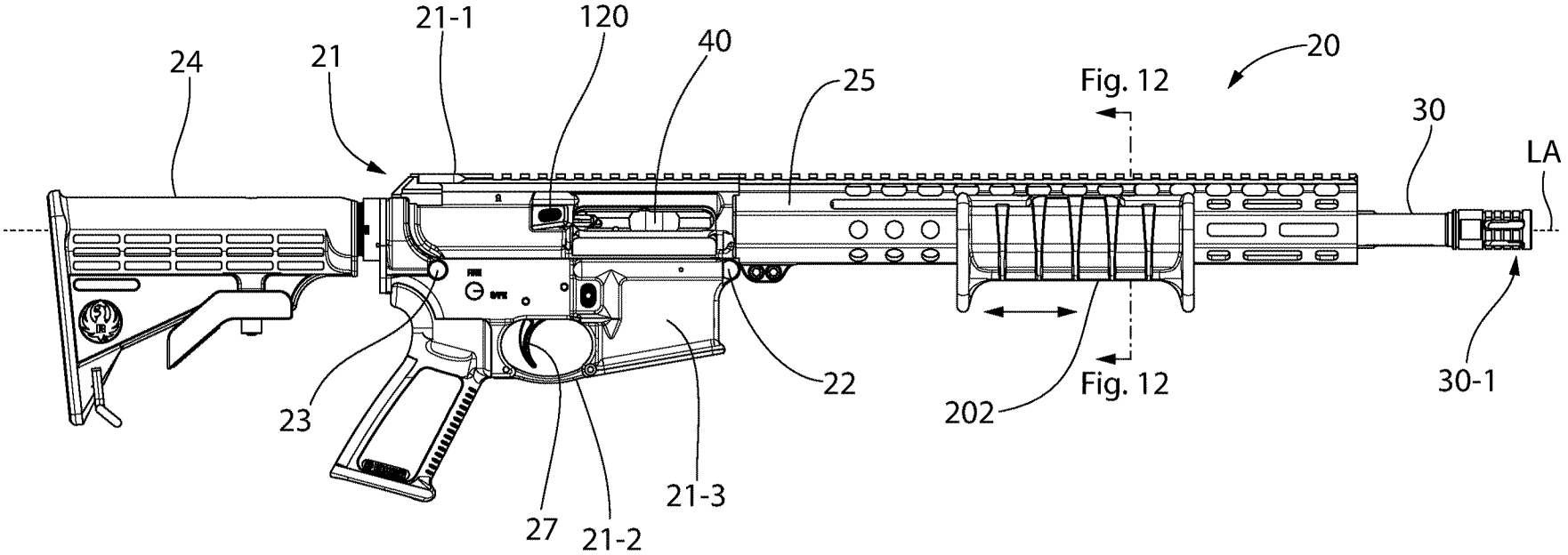
FIG. 1 is a right side elevation view of a firearm in the form of a pump action rifle according to the present disclosure.
Figure 2:
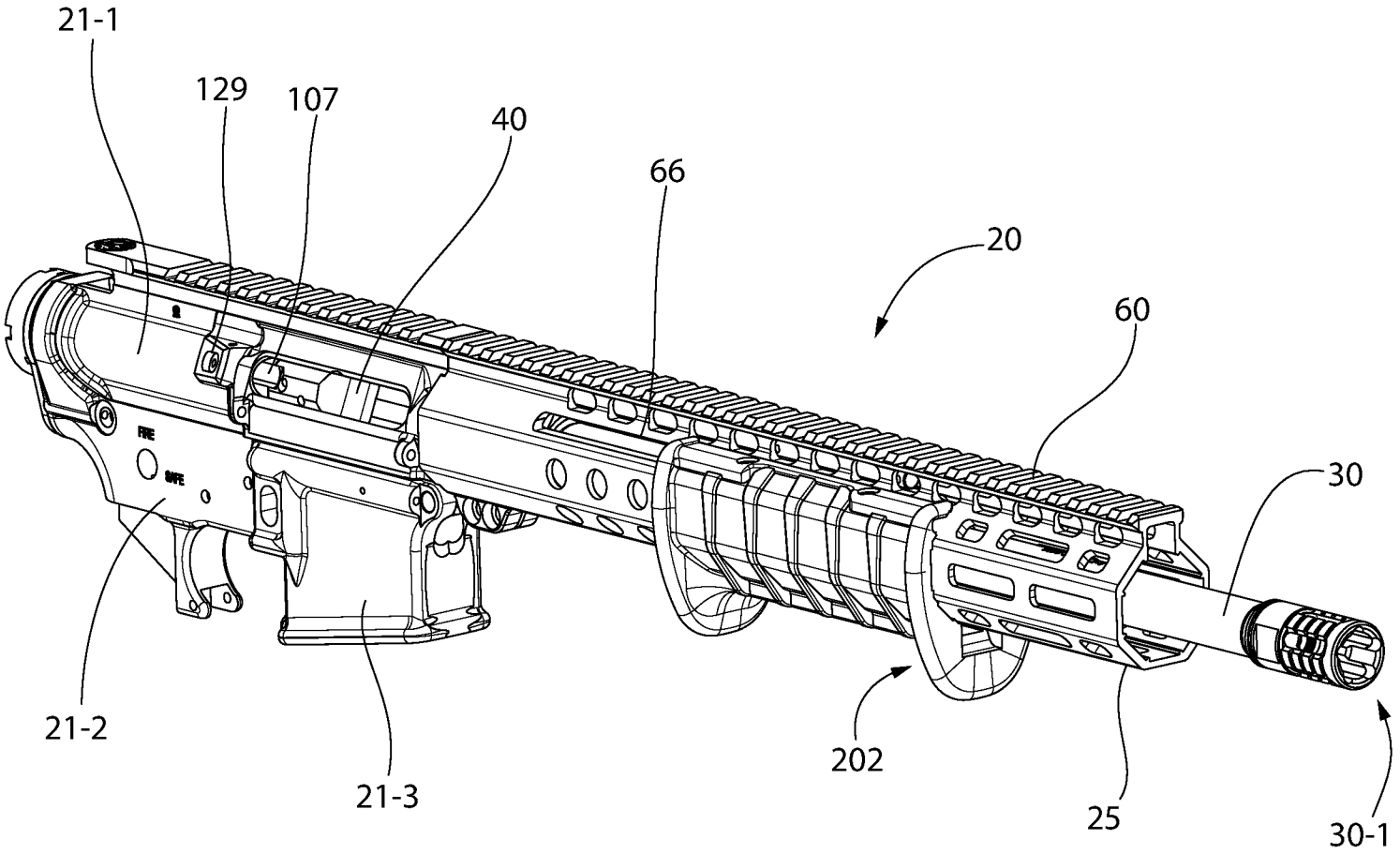
FIG. 2 is a right perspective view of the receiver, handguard, barrel and pump handle assembly of FIG. 1.

All drawings are schematic and not necessarily to scale.

DETAILED DESCRIPTION

The features and benefits of the invention are illustrated and described herein by reference to exemplary ("example") embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range.

General reference is made in the discussion which follows to all of the figures. Figures particularly applicable to the particular discussion at hand in some instances will be pointed out for reference, but are not limiting as other figures may show the same features.

FIGS. 1-12 depict one non-limiting embodiment of a manual slide or pump-action firearm 20 in the form of a rifle having a slide lock mechanism formed in accordance with the present disclosure. The rifle may be an AR-type rifle in one embodiment characterized by separate upper and lower receivers, among other aspects known to those skilled in the art for this type of rifle. The principles and features of firearm disclosed herein, however, may be embodied with equal benefit in other types of non-AR-type rifles or shotguns that utilize a pump style action to open and close the breech for loading an unloading ammunition. Accordingly, the invention is not limited in its applicability or scope to the AR-type firearm alone as described herein.

The firearm 20 generally includes a receiver 21 comprising an upper receiver 21-1, lower receiver 21-2 removably and pivotably coupled to the upper receiver by a transversely oriented front pivot pin 22 at a forward end, and a barrel assembly coupled to the upper receiver. This allows the lower receiver 21-2 to be hingedly opened to access the trigger and firing mechanism components housed in the lower receiver without uncoupling the lower receiver from the upper receiver. A transversely oriented second rear pin 23 at a rear end of the upper and lower receivers completes the coupling of the two receiver sections in typical AR-rifle fashion when fully assembled.

The lower receiver 21-2 primarily houses the trigger-operated firing mechanism and defines a magazine well 21-3 configured for removably receiving and retaining an ammunition magazine (not shown) in a conventional manner. The upper receiver 21-1 primarily houses the bolt slide 40 and ancillary components.

Further provided is a stock 24 attached to a rear end of the upper receiver 21-1 and a longitudinally-extending tubular handguard 25 extending forward from the front end of the upper receiver. Handguard 25 may be formed of a single one-piece monolithic unitary structure or multiple parts assembled together such as via fasteners. The stock 24 may be attached to the upper receiver via a conventional arrangement including a buffer tube 24-1 optionally containing an axially acting buffer or recoil spring 24-2 inside (see, e.g. FIG. 4). The spring biases the bolt slide 40 forward towards a closed breech position in battery with the barrel 30. Spring 24-2, which may be a compression coil spring in one non-limiting embodiment, provides assistance in returning the bolt slide forward when the action is cycled. In some embodiments, however, the recoil spring may be omitted is additional spring assistance is not desired. In one embodiment, the handguard 25 may be a floating style handguard, which only contacts an internally threaded barrel nut 35 at its rear end which is threadably coupled to a threaded projection or extension 36 on the front of the upper receiver 21-1. The barrel nut 35 is configured to mount and lock the barrel assembly to the receiver via an interference fit in a well known manner for AR-type rifles. The barrel extension 32 thus may include an external annular flange 37 at its rear breech end which becomes trapped between an internal annular abutment surface 38 inside the barrel nut 35 and upper receiver 21-1 for that purpose. The foregoing construction details described thus far are typical of an AR-type rifle platform and well known in the art without undue elaboration.

The barrel assembly includes a barrel 30 that defines a longitudinal axis LA of the firearm, a front muzzle end 30-1, and an opposite rear breech end 30-2 further defining a rearwardly open chamber 31 configured for holding an ammunition cartridge. A longitudinally-extending bore 43 is defined between ends 30-1, 30-2 which forms a passageway for a bullet, slug, or shot. The centerline of the barrel bore is coaxial with the longitudinal axis. The bore 43 may be rifled in some embodiments. An openable and closeable breech area (or simply "breech") is defined at the rear breech end 30-2 of the barrel 30. The elongated bolt 51 carried by the bolt slide further described below includes a forward facing breech face 39 which creates a closed breech when in battery with the rear breech end 30-2 of the barrel for firing the firearm, or alternatively an open breech for extracting/ejecting spent cartridge casings and loading fresh cartridges into the chamber. Such operation is well known in the art without further elaboration. In one embodiment, a barrel extension 32 may be mounted on the rear breech end of the barrel that defines a plurality of inwardly extending radial bolt locking lugs 54 for forming a locked breech with radial bolt lugs 53 on the head of the bolt, as further described herein. The barrel extension 32 may be threadably coupled to the breech end of the barrel 30 in one implementation.

Figure 4:
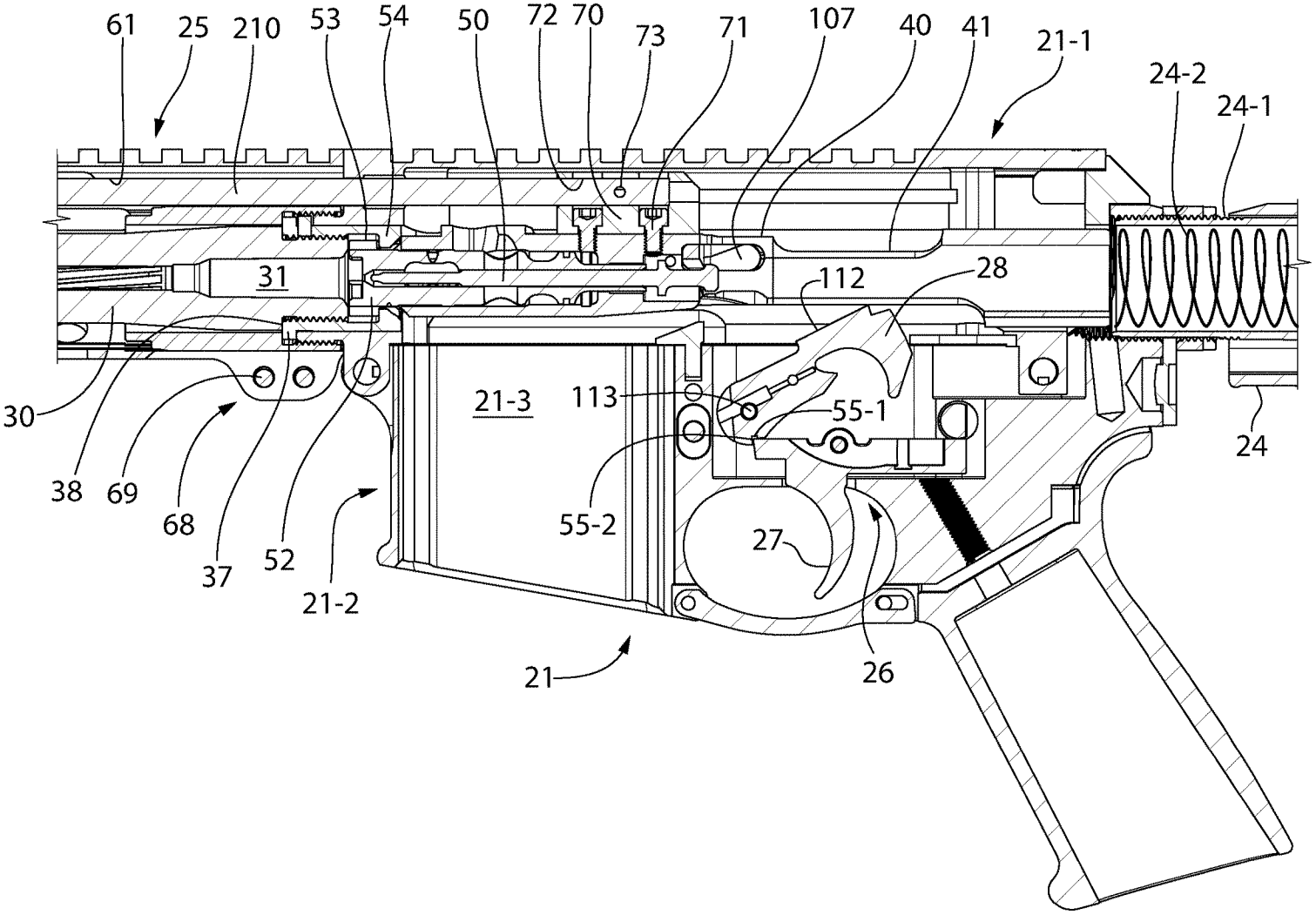
FIG. 4 is a left cross-sectional view of the receiver, firing mechanism, and barrel assembly.
Figure 5:
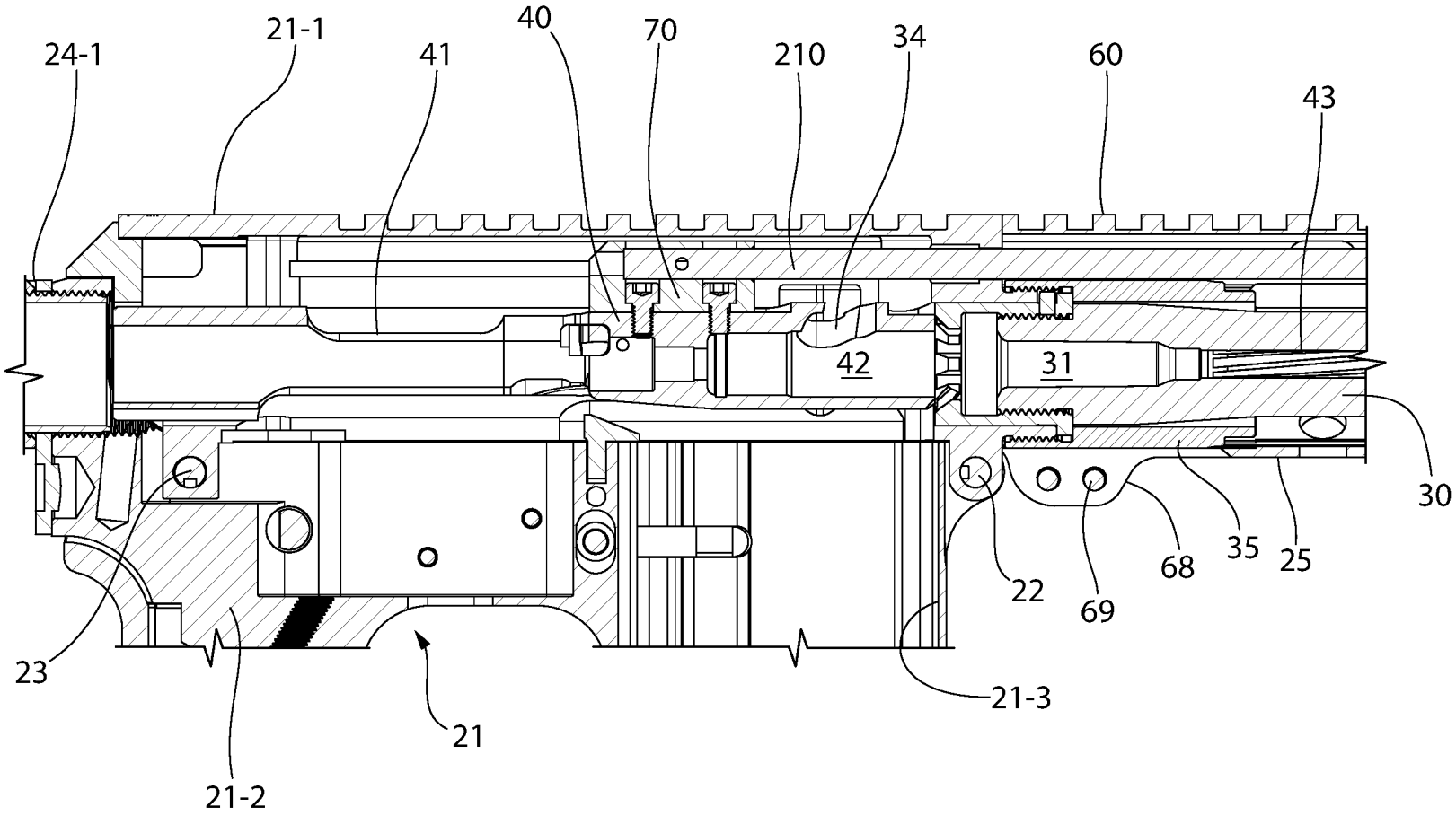
FIG. 5 is a right cross-sectional view of the receiver and rear portion of the barrel assembly.
Figure 6:
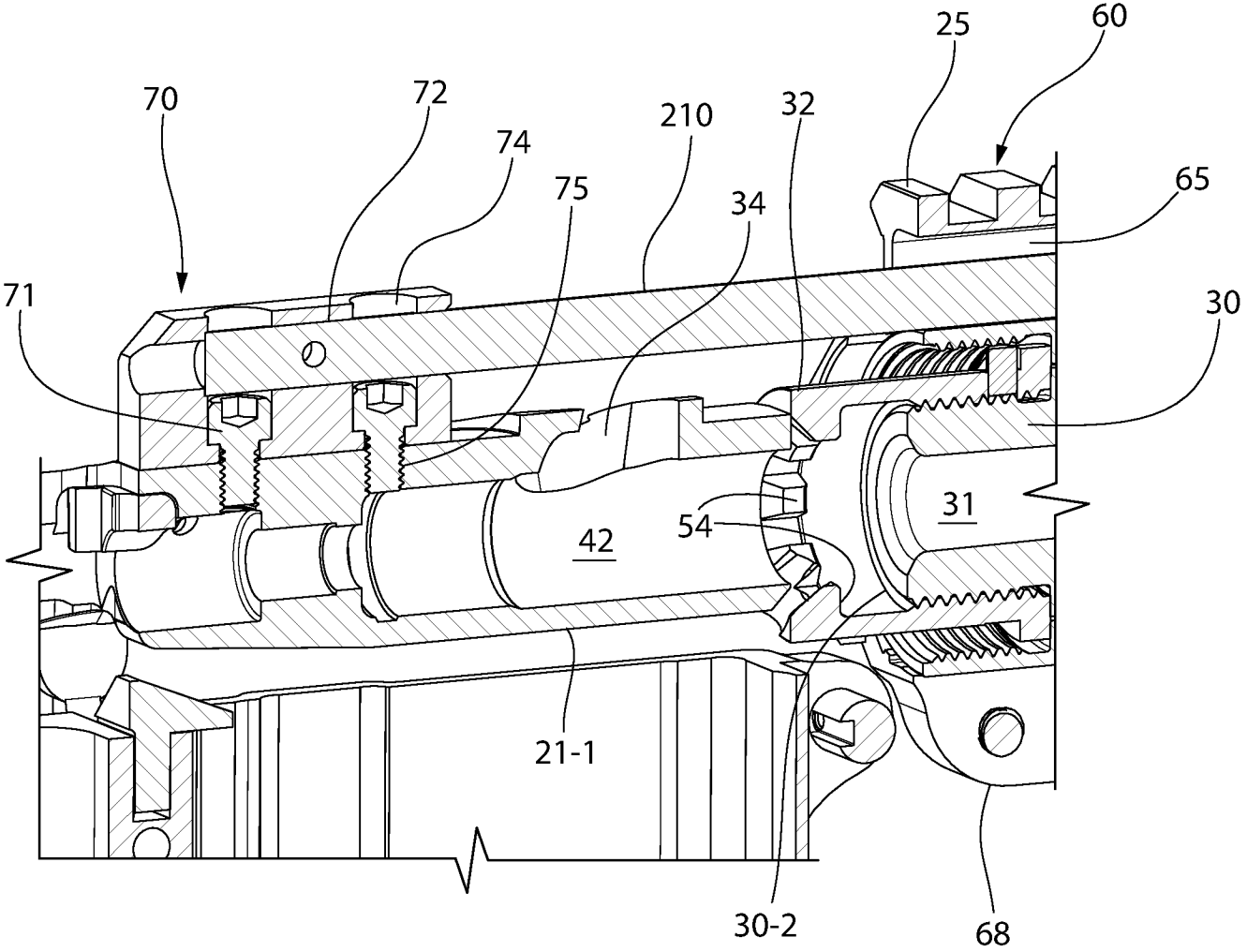
FIG. 6 is an enlarged right cross-sectional perspective view showing a portion of the pump action mechanism.
Figure 7:
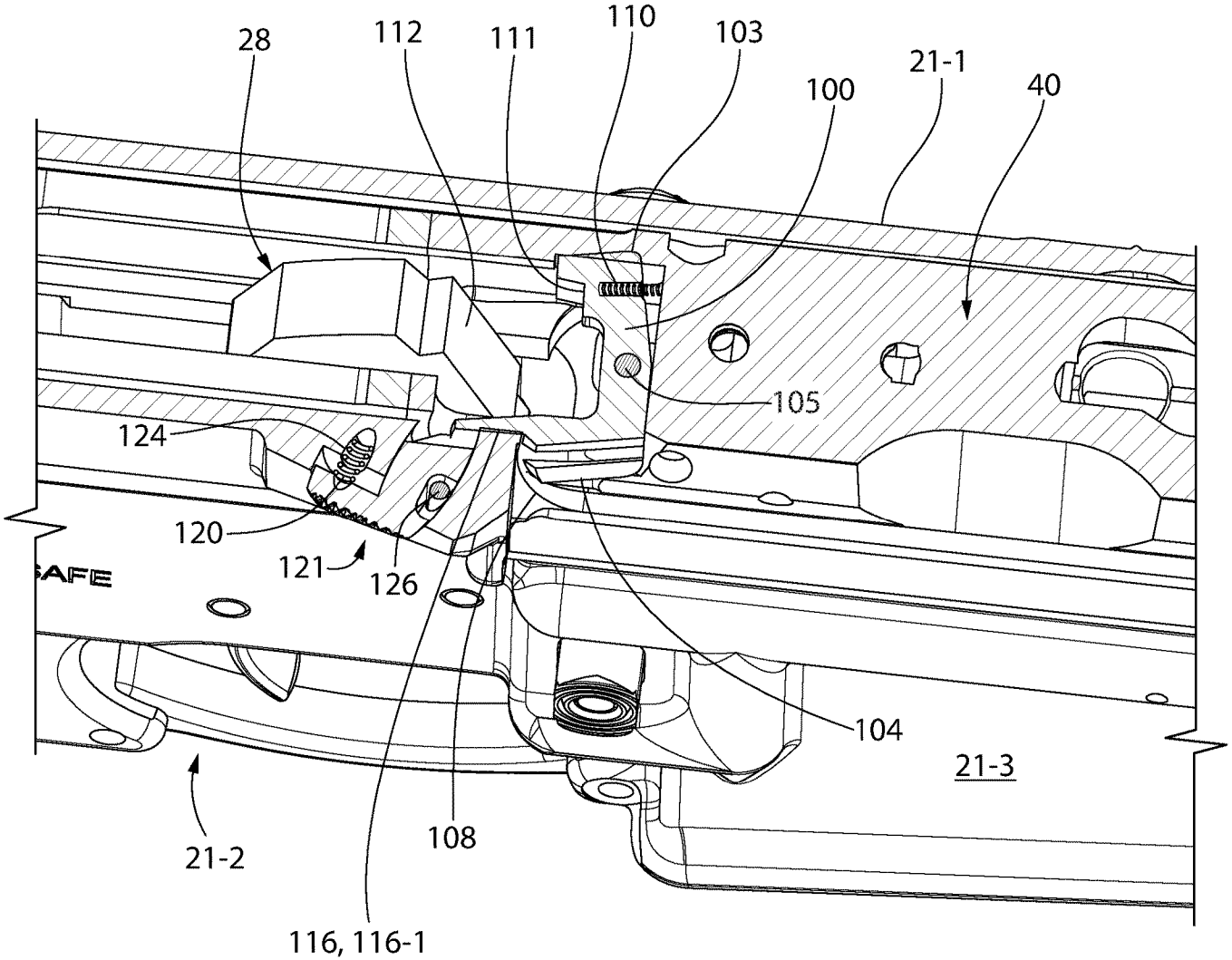
FIG. 7 is a top partial cross-sectional perspective view of the receiver showing a slide lock and firing mechanism components of the firearm of FIG. 1.
Figure 8:
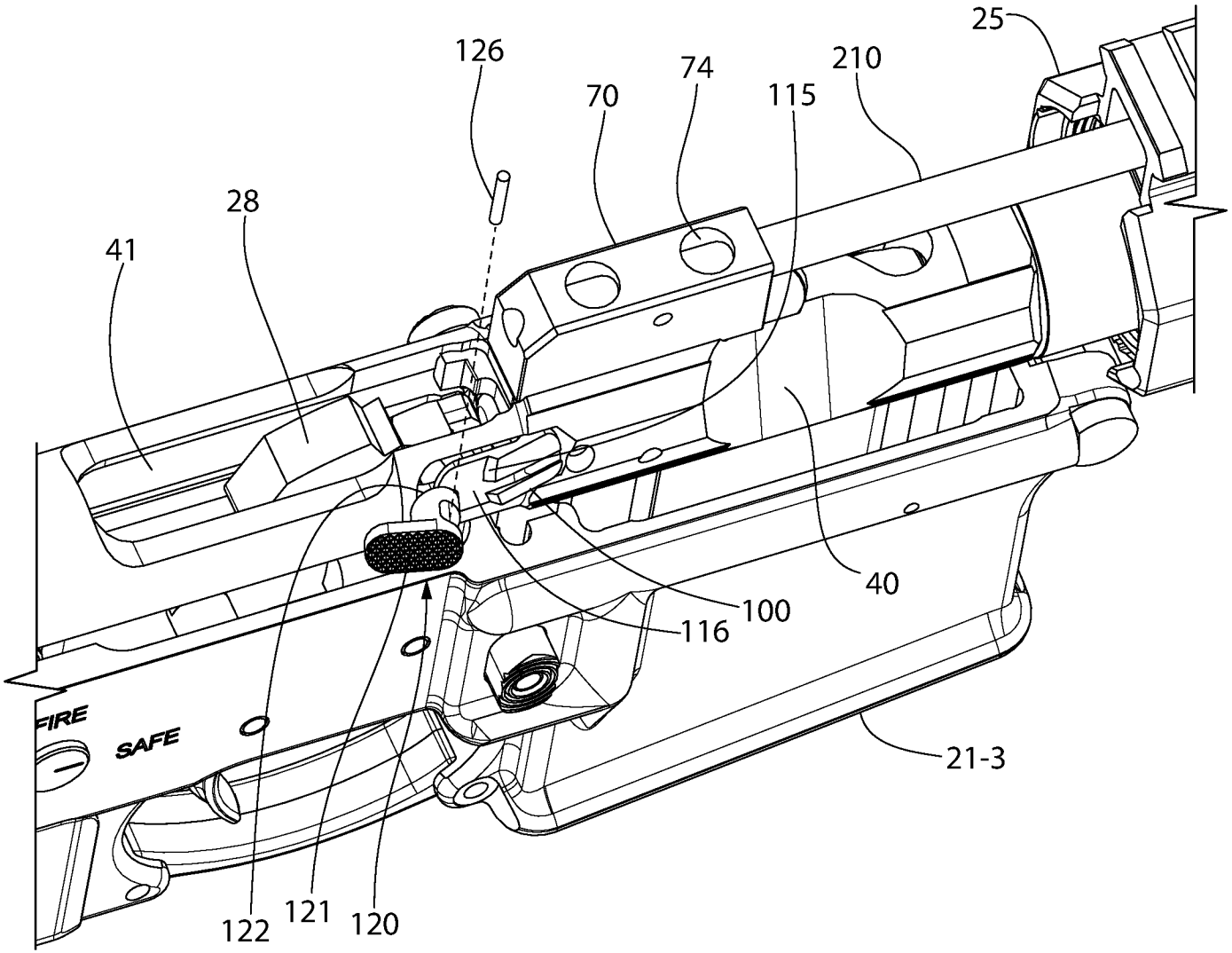
FIG. 8 is a top perspective view of the breech area of the firearm with portions of the upper receiver removed to better show the slide lock and other components of the firing and pump mechanisms.
Figure 9:
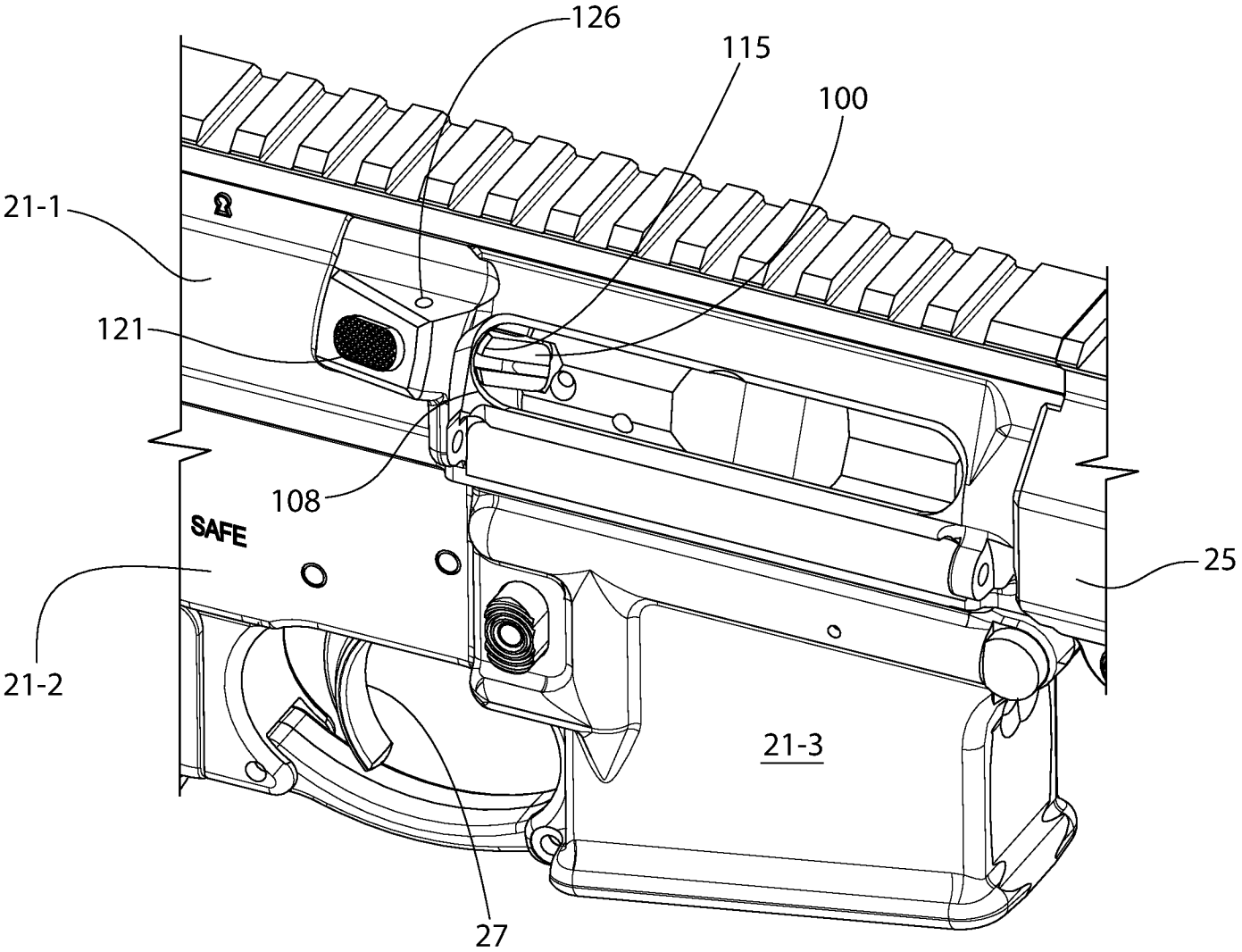
FIG. 9 is a top perspective view of the breech area of the firearm.

Referring to FIGS. 4 and 7-9, a trigger-actuated firing mechanism 26 operates to discharge the firearm 20. The firing mechanism may be mounted in the lower receiver 21-2, which may be pivoted to an open position for access to the firing mechanism components for maintenance as previously described herein. The firing mechanism generally comprises a trigger 27 movably (e.g. slideably or pivotably) mounted to the lower receiver and a spring-biased pivotable hammer 28 operably interfaced with the trigger for maintaining a cocked position of or releasing the hammer 28. The hammer 28 is pivotably moveable between a rearward cocked position and forward release position for discharging the firearm. The hammer is configured and arranged to strike a firing pin 50 slideably disposed in the bolt 51 carried by the bolt slide 40. The firing pin 50 has a front tip which is projectable beyond the forward breech face of the bolt 51 when struck by the hammer 28 to in turn strike a chambered cartridge. The rear end of the firing pin 50 struck by the hammer 28 is exposed in a longitudinal hammer slot 41 formed in the slide. The trigger 27 may be configured to act directly on the hammer 28 as shown in FIG. 4. This operates in the conventional manner to hold the hammer in a rearward cocked and ready-to-fire position until the trigger 27 is pulled. The hammer 28 may includes a trigger notch 55-1 which is engaged by a catch protrusion 55-2 on the trigger for this purpose. Pulling the trigger 27 with a closed breech rotates releases the cocked hammer 27 forward to strike the rear end of the firing pin 50, and in turn drives it forward to strike a chambered ammunition cartridge in chamber 31 for discharging the firearm.

Figure 12:
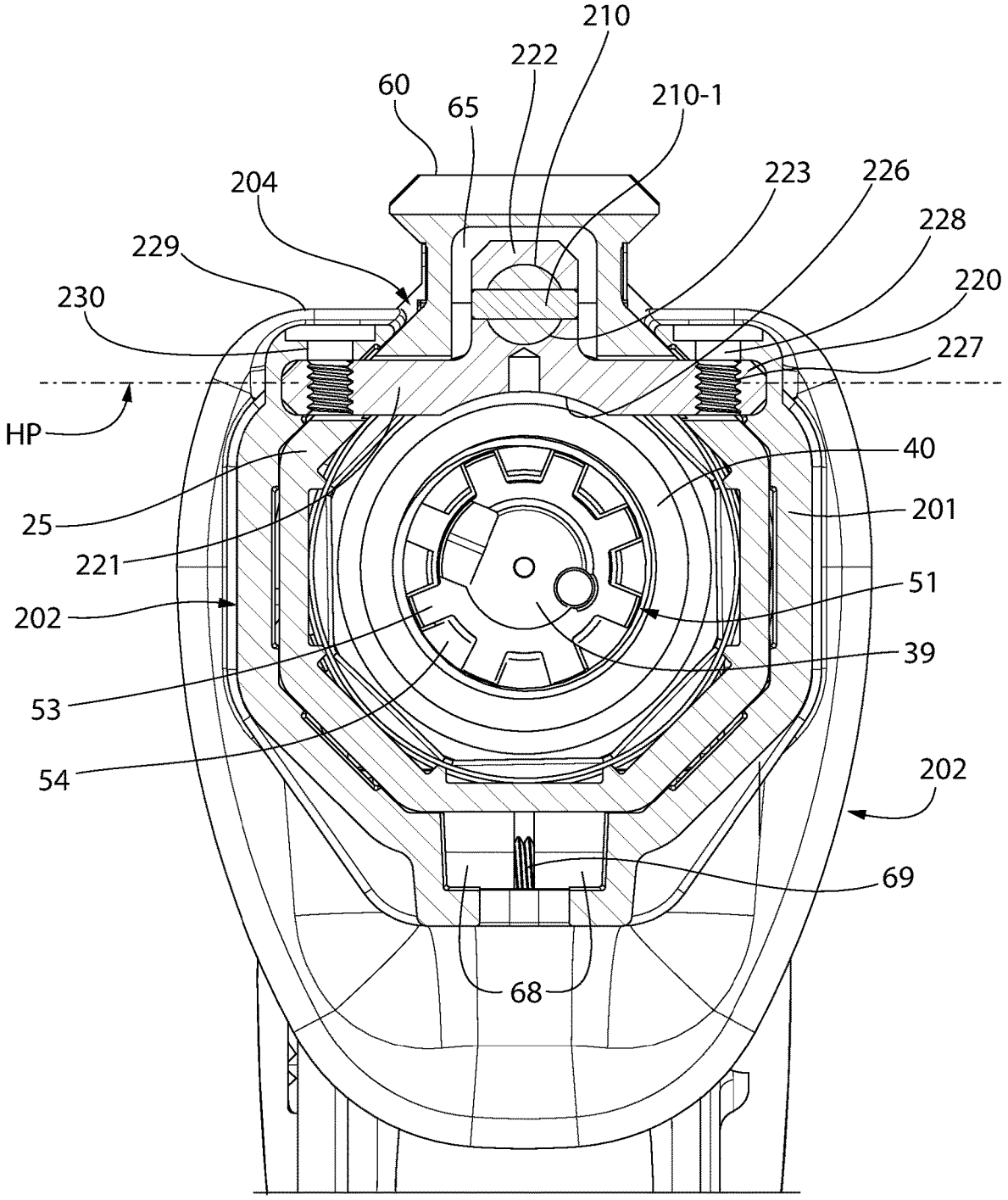
FIG. 12 is a transverse cross-sectional view of the firearm taken from FIG. 1.
Figure 13:
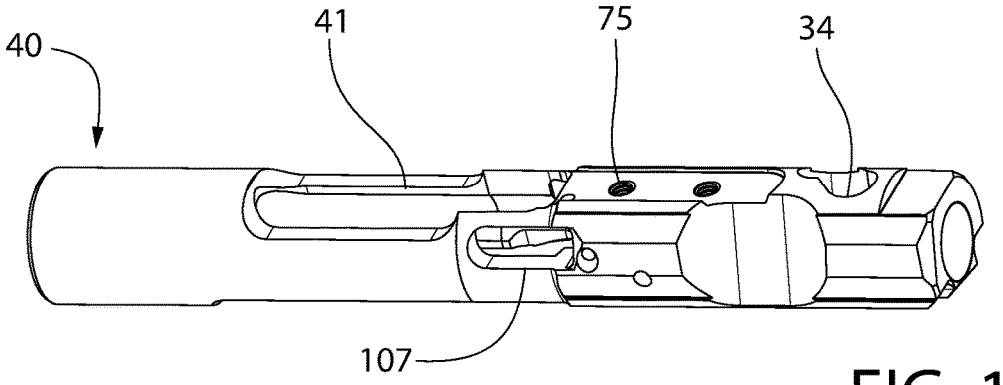
FIG. 13 is a first top perspective view of the slide bolt of the firearm.
Figure 14:
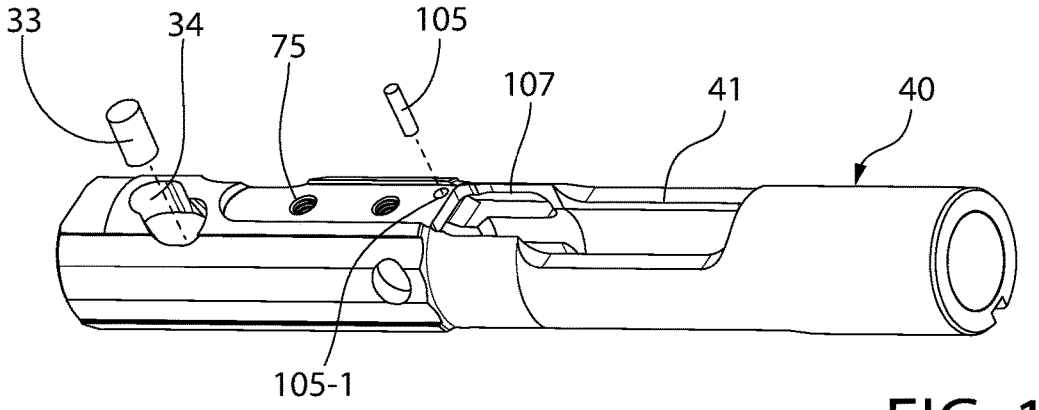
FIG. 14 is a second top perspective view thereof.
Figure 15:
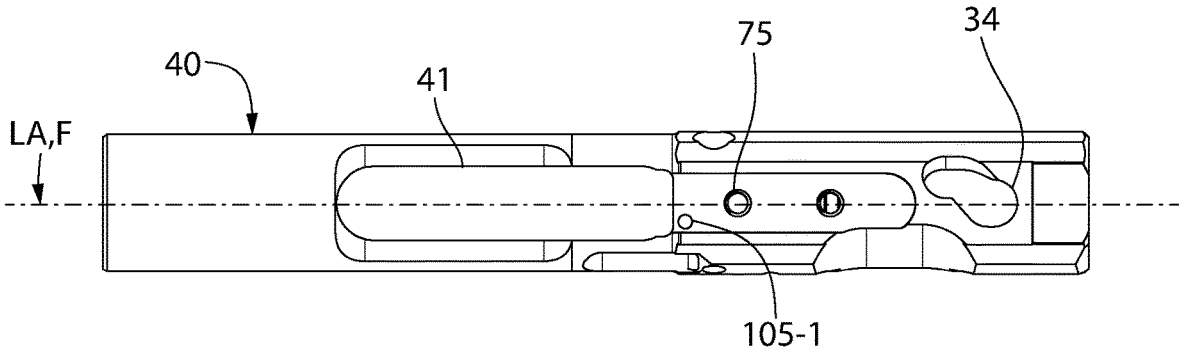
FIG. 15 is a top plan view thereof.

The bolt slide and pump mechanism will now be further described. FIGS. 13-15 show the bolt slide in isolation. Referring generally now to FIGS. 1-15, the bolt slide 40 (or alternatively simply "slide") is disposed in a longitudinal cavity 56 of the upper receiver 21-1 for rearward and forward axial movement therein. The bolt slide 40 is movable between a rear open breech position and forward closed breech position in battery with the bolt assembly. The bolt slide has an axially elongated body and includes a front end and a rear end. An axial cavity 42 is formed in the bolt slide from the front end to the rear end, and insects the elongated hammer slot 41. Cavity 42 may have a generally cylindrical shape. The front portion of the cavity 42 is configured for slideably and rotatably receiving the bolt 51 therein. The bolt defines an internal bore 43 which slideably receives the firing pin 50 therein. The bolt 51 has an elongated body and includes a front end defined by a bolt head 52 and a rear end with axial opening through which the rear end of the firing pin protrudes into the axially elongated hammer slot 41 formed in the bolt carrier 40. The hammer slot 41 receives the upper striking portion of the hammer therein which travels in an arcuate path when released by the trigger 27 for striking the rear end of the firing pin 50 to discharge the firearm.

The bolt head 52 protrudes axially forward from the front end of the bolt slide 40 and defines a vertical breech or bolt face 39 which abuts a chambered cartridge for support during firing (see, e.g. FIGS. 4-6 and 10). The front end of the firing pin 50 protrudes forward through the breech face for striking the chambered cartridge in chamber 31 of barrel 30. A plurality of bolt lugs 53 extend radially outwards from the bolt head 52. The radial bolt lugs 53 are arranged for insertion into the rear breech end of the barrel assembly. The bolt 51 with integral bolt head is rotatable in opposing directions relative to the bolt slide 40 and configured to engage the bolt lugs 53 with locking lugs 54 formed on the barrel extension 32 of the barrel assembly to lock the breech, or to disengage the bolt locking lugs to unlock the breech. In one embodiment, the bolt 51 includes a protruding cam pin 33 which travels in an oblong cam slot 34 formed in the bolt slide 40. When the bolt slide is moved forward or rearward in the upper receiver between the forward closed breech position and the rearward open breech position, interaction between the cam slot 34 and cam pin 33 cause the bolt 51 to rotate in the appropriate rotational direction to automatically lock or unlock the breech as the bolt slide is cycled rearward and forward via operation of the pump handle as further described herein.

The present firearm being described has a pump action mechanism configured to allow a user to manually cycle the bolt slide/bolt between the forward open breech and rearward closed breech positions. In one embodiment, the pump action mechanism 200 generally includes an externally mounted pump handle 202 and a mechanical linkage such as at least one operating rod 210 coupled between both the handle and bolt slide 40.

Referring generally to FIGS. 1-3 and 12, pump handle 202 has a generally U-shaped body including an open front end 206, open rear end 207, top wall 205, bottom wall 203, and pair of sidewalls 201 therebetween. A longitudinally-extending passage 208 extends between the ends 206, 207 for receiving the handguard 25 therethrough. Passage 208 may have a complementary configuration in transverse cross section to the handguard in some embodiments (best seen in FIG. 12).

The pump handle 202 may have a partial cylindrical configuration formed by the bottom wall 203 and the adjoining pair of arcuately curved circumferentially-extending sidewalls 201. Sidewalls 201 define an open top longitudinal channel 204 for receiving an upwardly protruding and longitudinally-extending top accessory rail 60 on the top 64 of the handguard 25 therein (see e.g. FIGS. 3 and 12). The longitudinal channel 204 has a front opening and a rear opening shared with the open front and rear ends 206, 207 of the handle, thereby allowing the handle to move forward and rearward along the length of the handguard 25 when manually cycling the action of the firearm 20. The pump handle 202 is thus positioned on the outside of the handguard 25 and encircles a majority of the circumference of the handguard except for the accessory rail 60 extending upwards from handguard 25 above the top of the handle.

The top accessory rail 60 may be configured as a section of a dovetail-shaped Picatinny rail or other type rail used in the art for mounting various accessories thereon such as laser or non-laser top sights. The handguard 25 may generally have a tubular substantially octagon shape in transverse cross section in one non-limiting embodiment; however, other cross-sectional shapes may be used such as circular. The handguard 25 may be a one-piece monolithic unitary structure or may be formed by an assembly of several parts fastened together. Handguard 25 has an axially elongated body including an open front end 61, open rear end 62, bottom 63, top 64, and circumferential sidewall 67 encircling the barrel of the firearm. The handguard 25 may include a downwardly protruding and laterally openable/closeable split clamp 68 which cooperates with a pair of transversely oriented threaded fasteners 69 (see, e.g. FIG. 12) to secure the rear end of the handguard to the barrel nut 35 in a free floating manner (i.e. the handguard is not supported directly from the barrel 30 of the firearm). The split clamp 68 may comprise a longitudinal slot formed between laterally opposing jaws which is spread laterally apart or together via loosening or tightening of the fasteners 69 respectively to clamp the rear of the handguard to the barrel nut 35.

The operating rod 210 may be cylindrical in configuration and is operably disposed inside the handguard 25. In one embodiment, the operating rod may be movably disposed in a longitudinally-extending passageway 65 formed in the upwardly protruding top accessory rail 60 of the handguard, as best shown in FIG. 12. The longitudinal passageway may extend for the full length of the handguard and includes at least an open rear end and optionally an open front end. In some embodiments, the front end of the handguard passageway 65 may be closed.

The operating rod 210 extends outwards and rearwardly from the longitudinal passageway 65 beyond the rear end 62 of handguard for coupling to the bolt slide 40. The rear end of the operating rod 210 may be fixedly coupled to the bolt slide by a key block 70 mounted thereon in one embodiment. The key block 70 may be mounted on the top of the bolt slide 40, and in a position forward of the hammer slot 41 in one example arrangement (see, e.g. FIGS. 3-6). Other mounting locations are possible. In one embodiment, the operating rod 210 may be cross-pinned to the key block by pin 73 inside a forwardly open axial socket 72 formed in the key block 70 that receives the rear end of the rod therein. The key block 70 may be mounted to the bolt slide 40 in any suitable manner, such as via one or preferably a pair threaded fasteners 71 such as cap screws in one non-limiting example as shown. Fasteners 71 are received through mating upwardly open holes 74 in the key block 70 (see, e.g. FIG. 6) and rotatably engage threaded holes 75 in the top of the intermediate portion of the bolt slide 40 between the hammer slot 41 and cam slot 34 (see also FIGS. 13-15).

Figure 3:
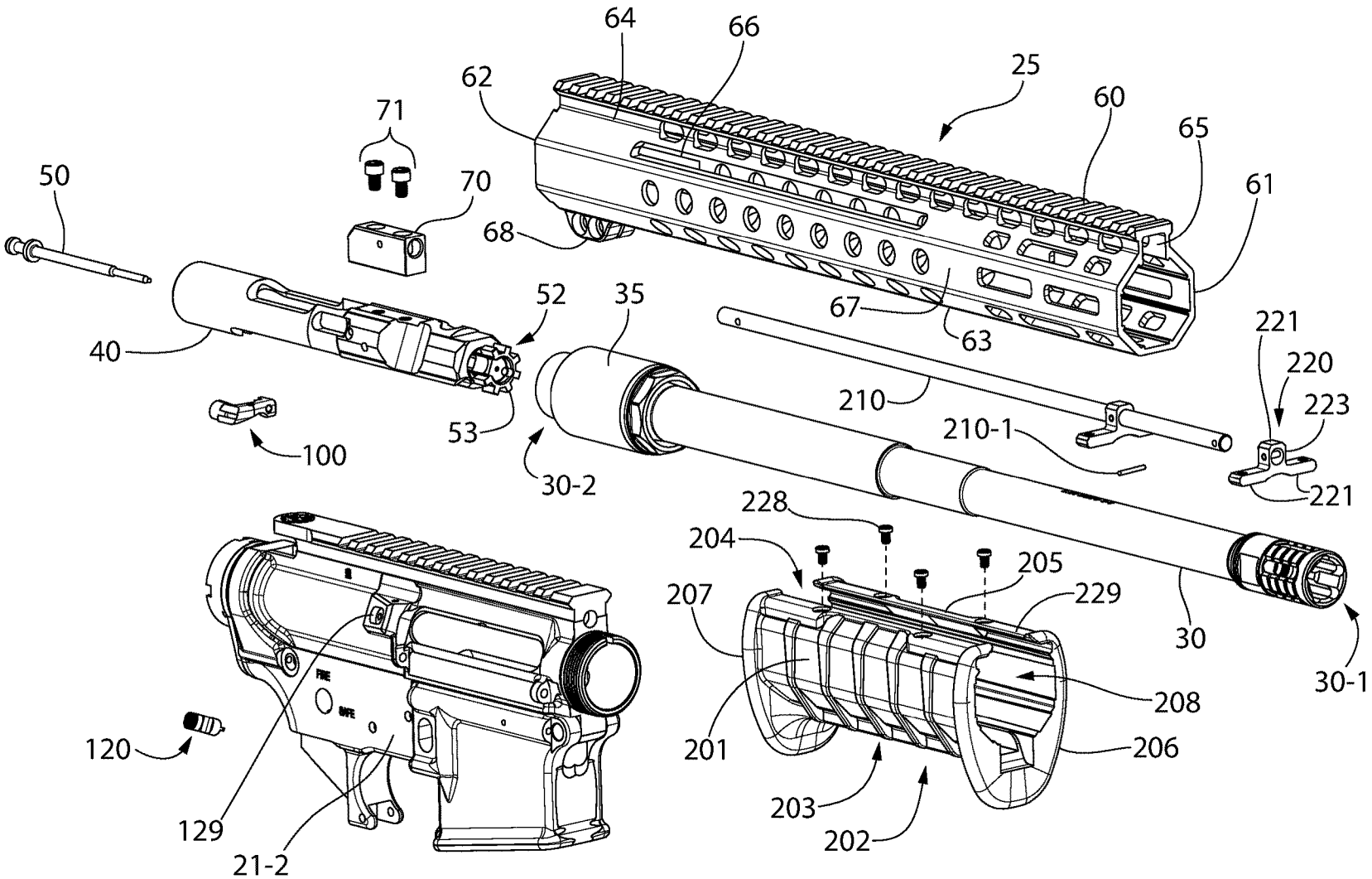
FIG. 3 is an exploded perspective view thereof including internal portions of the pump action mechanism.

The portions of the operating rod 210 forward of key block 70 may be coupled to the pump handle 202 via a yoke 220 supported by and slideably mounted to the handguard 25. At least one yoke 220, but preferably two yokes are provided for stabilizing the linear forward/rearward motion of the operating rod 210. The yoke 220 may have a generally T-shaped body which is inverted when mounted to the firearm as best shown in FIGS. 3 and 12. The yoke 220 has two elongated lateral support arms 221 which extend horizontally and outwardly from a vertically elongated central portion or protrusion 222 of the yoke. Support arms 221 extend in opposing lateral directions transverse to the longitudinal axis LA of the firearm 20. In one configuration, the support arms 221 may be transversely aligned and parallel to each other, and therefore lie in a common a horizontal reference plane Hp. In other configurations, each arm may be obliquely angled to the horizontal reference plane and each other. A central axial opening 223 is formed in the central protrusion 222 of the yoke body above and between the arms 221. Opening 223 slideably receives the operating rod 210 therethrough. The central protrusion 222 of yoke 220 extends upwards into the longitudinally-extending passageway 65 formed in the upwardly protruding top accessory rail 60 of the handguard (see, e.g. FIG. 12) for mounting to the operating rod 210.

The operating rod 210 may be fixedly/rigidly affixed to the yoke 220 in any suitable manner, such as for example without limitation pins or threaded fasteners. In one embodiment, the yoke 220 is cross-pinned to operating rod 210 by a cross pin 210-1 (see, e.g. FIG. 12). Other means of attachment such as welding, soldering, shrink-fitting, or adhesives may be used to achieve a rigid fixation. In one embodiment, the central axial opening 223 may be formed in the upright central protrusion 222 extending vertically upwards from the central portion of the yoke between the support arms 221. The central opening for the operating rod therefore does not lie in the same horizontal reference plane Hp as a the support arms of the yoke in the illustrated embodiment, but instead is positioned above the plane Hp and support arms.

Each lateral support arm 221 of the yoke 220 is configured and arranged for coupling to the external pump handle 202 through the handguard 25. In one embodiment, the handguard includes two axially extending longitudinal travel slots 66 formed on opposite sides of the handguard which each receive one of the support arms therethrough. Support arms 221 extend outward completely through the handguard from the interior of the handguard through the longitudinal travel slots 66 and beyond the exterior surface of the handguard as shown for coupling directly to the pump handle external to the handguard. The support arms 221 slideably engage the travel slots 66 when the action is manually cycled rearward and forward by the user. Travel slots 66 extend axially for at least a distance of the handguard 25 commensurate with the length of travel of the pump handle 202 along the handguard when the action is cycled. The front and rear ends of the slots 66 are spaced inwards from the front and rear ends 61, 62 of the handguard 25.

In one embodiment, referring to FIG. 12, the support arms 221 of the yoke 220 may be fixedly but removably coupled to the pump handle 202 via threaded fasteners 228 such as screws. Each support arm of the yoke 220 may have an upwardly open threaded hole 227 that threadably engages a fastener 228 which extends through concentrically aligned plain mounting holes 230 formed in an opposed pair of top mounting portions 229 of the pump handle 202. The top mounting portions 229 may be formed on each lateral side of the longitudinal channel 204 and extend laterally inwards towards the channel. In some embodiments, the mounting portions 229 may be substantially flat and extend horizontally inwards from the arcuately curved sidewalls 201 of the pump handle 202 as best shown in FIG. 12. Other means of attaching the yoke 220 to the pump handle 202 may be used in other embodiments. It bears noting that the pump handle 202 may be completely supported by the yoke 220 in one embodiment without direct support from the handguard 25. An annular gap 231 may thus be formed between the pump handle 202 and handguard 25 in this instance as shown in FIG. 12.

Figure 10:
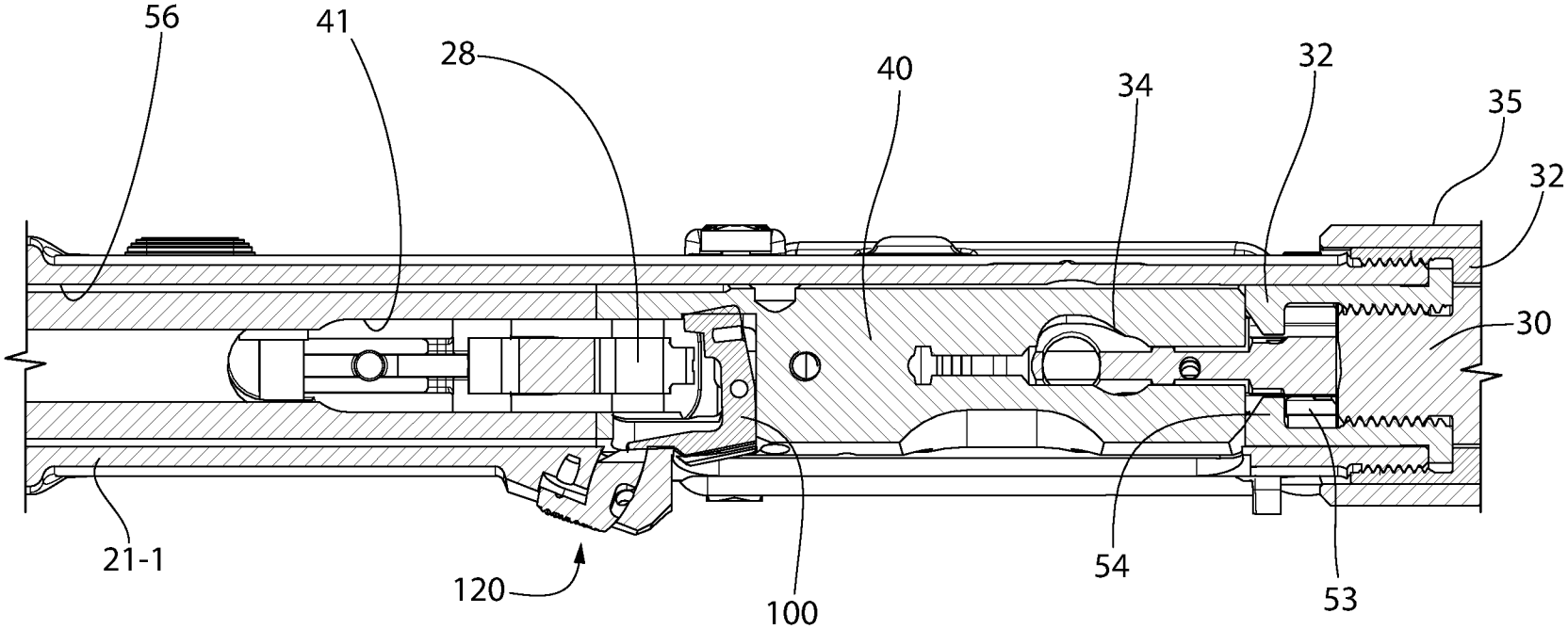
FIG. 10 is a top longitudinal cross-sectional view of a portion of the firearm.

The yoke 220 in turn may be supported by handguard 25 alone, or alternatively by both the handguard and the top of the barrel 30 in one embodiment. A bottom surface of the yoke may include an arcuate and downwardly open concave recess 226 configured to slideably engage a corresponding top convex surface of the barrel 30 for rearward/forward movement thereon (see, e.g. FIG. 12). Yoke is primarily supported however by the handguard 25 via slideable engagement via the longitudinal travel slots as previously described. As shown in FIG. 10, the yoke(s) extend laterally through the handguard 25 and across/over the barrel 30, but do not extend around or encircle it. In some embodiments, the yokes 220 may be completely supported by the handguard alone and avoid contact with the barrel. In other possible embodiments, the yokes 220 may contact the top of the barrel 30 for guidance as noted above, but are still primarily supported by each lateral side of the handguard as shown.

In operation, starting with a closed and locked breech, pulling the pump handle 202 rearward pushes and slides the bolt slide 40 rearward simultaneously with the handle via the operating rod 210 linkage. The bolt head 52 rotates and unlocks from the barrel locking lugs 54 via the cam pin 33 and slot 34 interaction as previously described herein to unlock the breech. The assembly of the operating rod 210, yokes 220 mounted thereon, and bolt slide 40 are all operably and rigidly linked together to travel rearward in unison while the barrel 30, receiver 21, and handguard 25 remain stationary to open the breech. The support arms 221 of the yokes 221 slide each along and within their respective longitudinal slots 66 in the handguard 25 along with the pump handle 202. It bears noting that the dual set of yoke arms 221 provide two sliding points of engagement with the handguard, thereby maintaining a stable rotational position of the operating rod 210 that prevents twisting. This advantageously ensures smooth sliding movement and travel of the assembly both rearward and forward. As the bolt slide 40 moves rearward, the spent cartridge casing is extracted from the barrel chamber 31 and ejected through the ejection port 130 on the right side of the upper receiver 21-1. The extractor mounted on the bolt and ejector are now shown. When the user moves the pump handle 202 and slide 40 concomitantly forward assisted by the buffer or return spring 24-2 which has been compressed by opening the breech, a new cartridge is uploaded into the breech area from the stack of spring-biased cartridges in the box style magazine mounted in the magazine well 21-3 of the lower receiver 21-2. As the bolt slide 40 continues forward, the new cartridge is stripped from the magazine by the bolt 51 and chambered. The breech is reclosed and re-locked for firing the next round.

The slide lock mechanism of the firearm 20 will now be described in further detail with general reference to FIGS. 1-11. The mechanism generally includes a slide lock 100 pivotably mounted to bolt slide 40 in the receiver 21 (i.e. upper receiver 21-1), and a manually operated actuator 120 pivotably mounted to the upper receiver. In one embodiment, slide lock 100 may be mounted to an intermediate portion of the bolt slide 40 between its front and rear ends just forward and proximate to the hammer slot 41 in the slide. This allows the hammer to contact/strike, and automatically actuate the slide lock when the firearm is discharged via a trigger pull, as further described herein (best shown in FIGS. 7-8 and 10-11).

The slide lock 100 is pivotably movable in a horizontal plane about a vertical axis of rotation between a locked position preventing the bolt slide from being moved rearward, and unlocked position allowing the bolt slide to be manually move rearward by the user using the pump handle.

Figure 16:
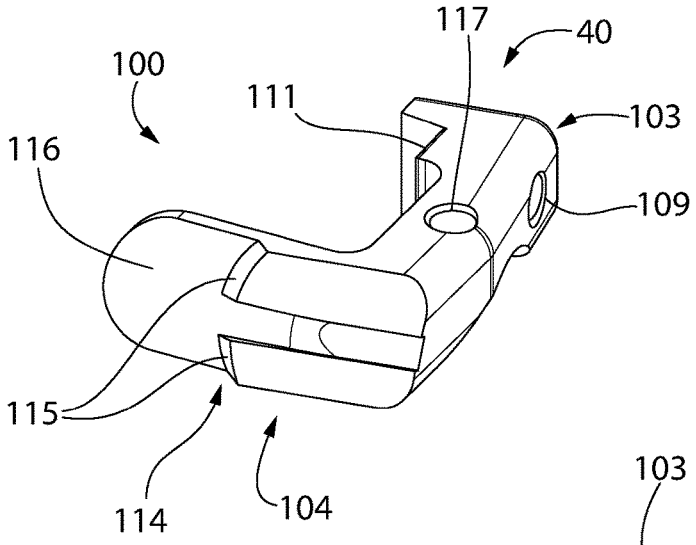
FIG. 16 is a top front perspective view of the slide lock.
Figure 17:
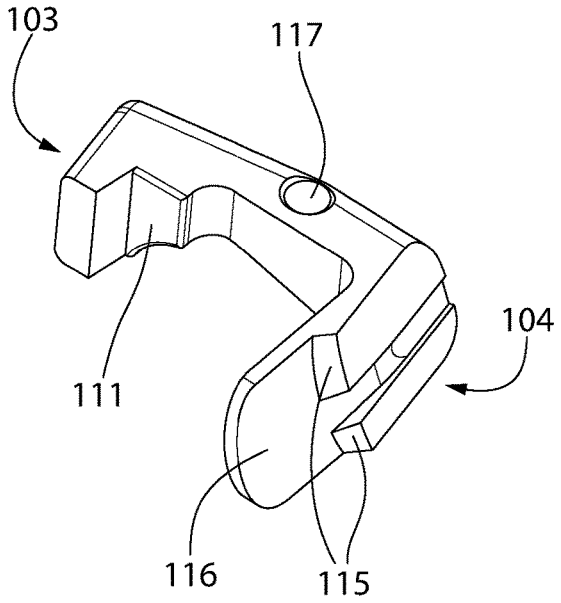
FIG. 17 is a top rear perspective view thereof.
Figure 18:
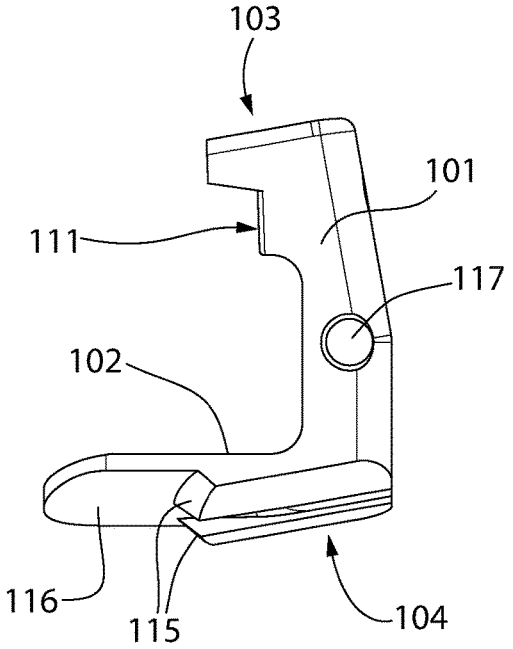
FIG. 18 is a top plan view thereof.
Figure 19:
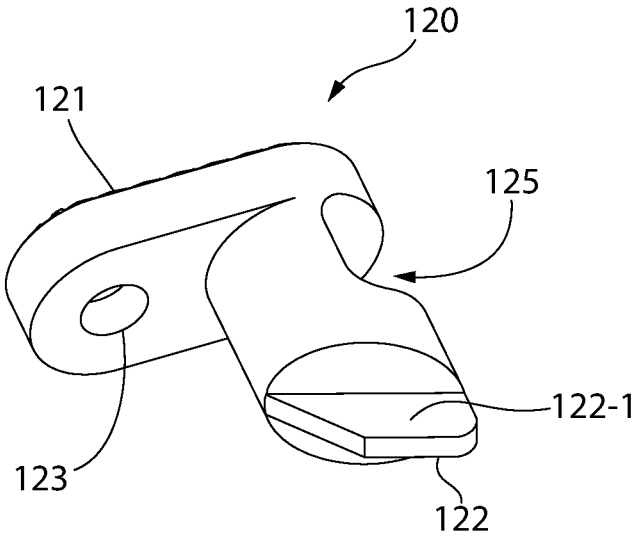
FIG. 19 is a first perspective view of a manual slide lock actuator according to the present disclosure.
Figure 20:
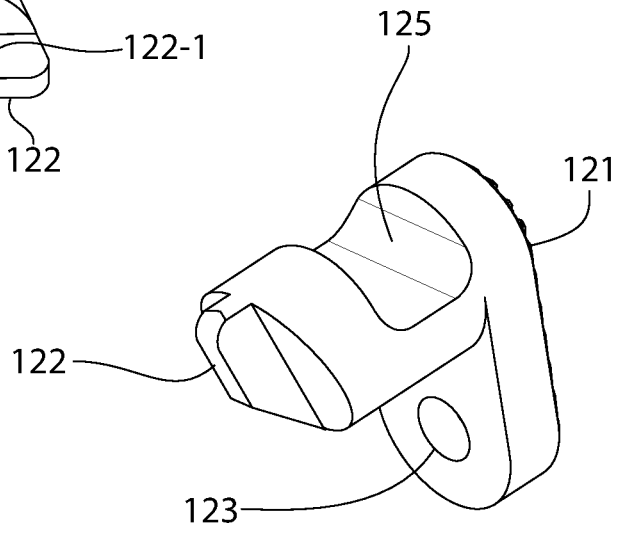
FIG. 20 is a second perspective view thereof.
Figure 21:
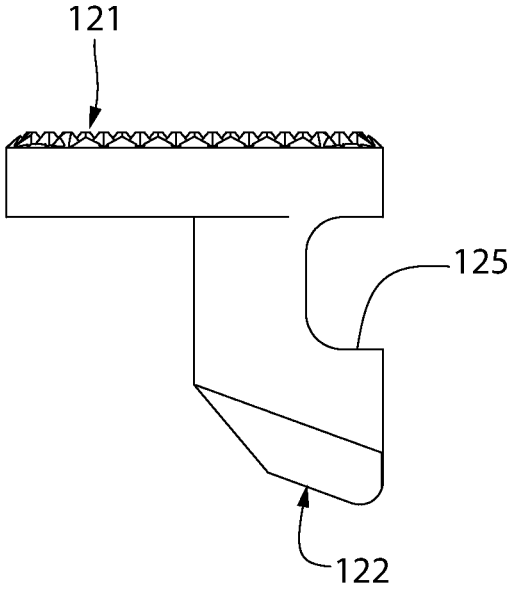
FIG. 21 is a top plan view thereof.

FIGS. 16-18 show the slide lock 100 in isolation. In one embodiment, slide lock 100 may have a generally L-shaped body 100-1 including a main transverse or lateral section 101 extending across the bolt slide 40 and upper receiver 21-1 between its sides, and a longitudinal section 102. Slide lock body 100-1 defines a left actuation end 103 and an opposite rearwardly-swept right operating end 104 collectively defined by longitudinal section 102 and lateral section 101. A vertically oriented pivot pin 105 transversely and vertically oriented with respect to the longitudinal axis LA and between the left and right ends 103, 104 of slide lock 100 defines the pivot axis (axis of rotation) of the slide lock. The pivot pin 105 extends through a vertical hole 117 in the main lateral section 101 of slide lock body (see, e.g. FIGS. 16 and 18). As previously described herein, slide lock 100 may be mounted on the top of the intermediate portion of bolt slide 40 just forward of hammer slot 41 via a pin hole 105-1 in the slide which receives pivot pin 105 (see, e.g. FIG. 13-15). Hole 105-1 is laterally offset from the firing axis F of hammer 28 and establishes the offset position of the slide lock pivot axis relative to the slide bolt 40 and receiver 21. Slide lock 100 may be disposed in an upwardly open cavity 106 at this location on the bolt slide 40. Bolt slide 40 may include a laterally open window 107 through which the operating end 104 of the slide lock extends to engage the interference surface 108 disposed in the upper receiver 21-1 for locking the bolt slide in the forward closed breech position. Window 107 may be complementary configured to the rearwardly-swept operating end 104 of slide lock 100 and is therefore axially elongated in the shape of a slot with closed ends as shown.

Referring to FIGS. 1-11, the axially elongated longitudinal section 102 of the slide lock body 101 projects rearward from the lateral section 101 at the right operating end 104 of the slide lock giving the operating end a rearward-swept configuration. The longitudinal section 102 may therefore extend rearward farther than the left actuation end 103 of the slide lock 100 defined by lateral section 101 in one embodiment (see, e.g. FIG. 11). The front end of the longitudinal section 102 may be integrally formed with the main lateral section 101 of the slide lock which may be a one-piece unitary structure. The longitudinal section 102 may be oriented substantially parallel to longitudinal axis LA while lateral section 101 may be oriented substantially transverse to the longitudinal axis when slide lock is mounted on bolt slide 40 in the firearm. The longitudinal section 102 may thus be oriented approximately perpendicular to the main lateral section 101 of the slide lock as shown.

The lateral section 101 of slide lock 100 includes a forwardly open spring slot 109 which receives a biasing spring 110 for biasing the slide lock into a locked position (see also FIGS. 16-18). In the locked position, the operating end 104 of the slide lock projects laterally outwards the most to engage the interference surface 108 of the upper receiver 21-1. The rear end of the spring 110 is received in the spring slot 109 and the opposite front end engages a rear facing surface on the intermediate portion of the bolt side 40. In one embodiment, the spring 110 may be a coiled compression spring; however, other type of spring may be used to provide the biasing action to the slide lock. The spring 110 engages a portion of the transverse lateral section 101 of the slide lock 100 at the spring slot 109 to the left of the pivot pin 105, thereby biasing the left actuation end 103 of the slide lock rearward and the right operating end 104 in an opposite forward direction.

Figure 11:
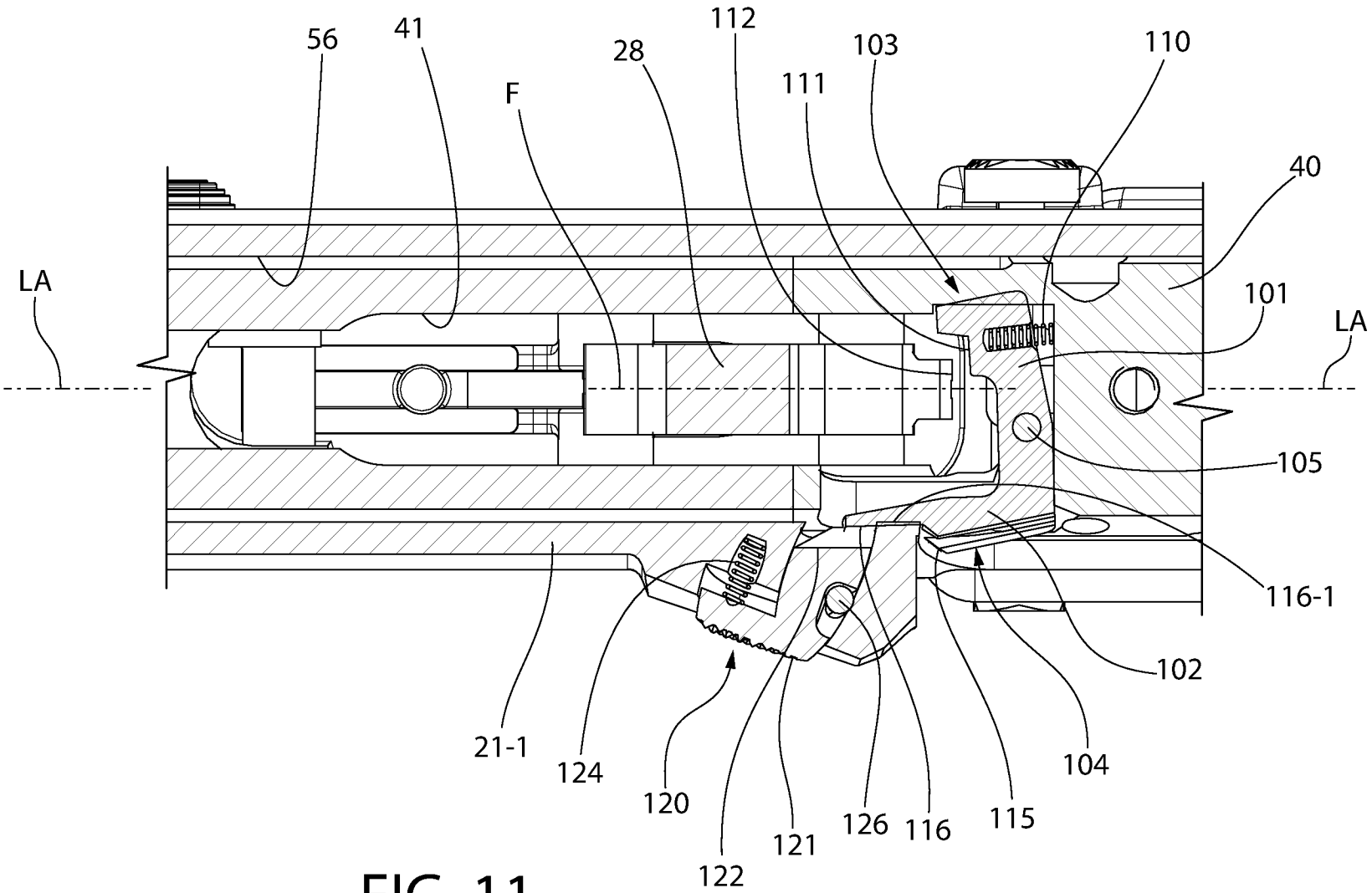
FIG. 11 is an enlarged view taken from FIG. 10.

In one configuration, the pivot pin 105 of the slide lock 100 is laterally offset to the right of the hammer 28 and its travel path or line of action (i.e. firing axis F) as best shown in FIG. 11. The firing axis F is thus parallel to longitudinal axis LA lying in the same vertical plane along the centerline of the firearm and laterally/transversely offset from the pivot pin 105. When the firearm is discharged, this placement causes the hammer 28 to strike the left lateral actuation end 103 of the slide lock off-center from its axis of rotation. The left actuation end 103 of the slide lock 40 in turn rotates clockwise and forward about pivot pin 105, and the right operating end 104 concomitantly rotates clockwise and rearward (rotational direction as viewed in FIG. 11). This action moves the slide lock 100 from the locked position shown to the unlocked position, as further described herein. The left actuation end 103 of the slide lock 100 (i.e. left portion of the main lateral section 101) includes a rearward facing actuation surface 111 which is engaged and struck by a forward facing portion or contact surface 112 of the hammer 28 as it rotates forward about its horizontal pivot axis and axis of rotation defined by a hammer pivot pin 113 (see, e.g. FIG. 4). This may be part of the same vertically elongated contact surface 112 that strikes the rear end of firing pin 50 within the hammer slot 41 of the bolt slide. The hammer 28 moves in an arcuate path along its firing axis F in a vertical plane. Conversely, the slide lock 100 pivots in a horizontal plane perpendicular to the vertical plane about its vertical pivot axis defined by pivot pin 105 received through the laterally offset vertical hole 117 of the slide lock from the firing axis F of hammer 28.

With continuing reference to FIGS. 1-11 and 14-16, the slide lock 100 further includes stepped shoulder 114 defining a rear facing locking surface 115 which lockingly engages a forward facing interference surface 108 disposed on the upper receiver 21-1 to form the locked position of the slide lock. The shoulder 114 may have a split configuration as shown in the depicted embodiment dividing the locking surface into a pair of closely spaced locking surfaces 115 in one implementation. In one embodiment, the interference surface 108 may be formed on the upper receiver at the rear end of the ejection port 130. The ends of ejection port 130 at the interference surface 108 may be arcuately rounded. The locking surface(s) 115 preferably have a complementary arcuately convex configuration to the arcuately concave configuration of the interference surface 108. The stepped shoulder 114 and its locking surfaces 115 are formed on the right operating end 104 of the slide lock, and more particularly in some embodiments on the axial longitudinal section 102 of the slide lock as shown. The locking surfaces 115 may be obliquely angled or sloped to the longitudinal section of the slide lock 100 and the longitudinal axis LA. This allows the locking surfaces 115 to smoothly disengage from the interference surface 108 when the slide lock is rotated from the locked position to unlocked position.

Although the interference surface 108 may be conveniently formed on the ejection port 130 in the depicted embodiment to avoid having to create a separate surface for this purpose, the interference surface may alternatively be formed on any other forward facing surface that might be provided. Accordingly, the interference surface need not necessarily be associated with the ejection port. The invention is expressly not limited to utilizing the ejection port for the interference surface.

The longitudinal section 102 and right operating end 104 of slide lock 100 further includes a laterally outward facing push surface 116 which enables a user to manually unlock the slide lock 100 for unloading a chambered round of ammunition without firing the firearm. Push surface 116 is positioned rearward of the locking surfaces 115 on longitudinal section 102 and arranged for engagement by manual actuator 120 slideably mounted on the right lateral side of upper receiver 21-1, as further described herein. Push surface 116 additionally provides a rotational travel stop feature. Push surface 116 engages a laterally inward facing stop surface 116-1 formed on the upper receiver 21-1 which acts as a travel stop to limit the counter-clockwise rotation of slide lock 100 under the biasing action influence of operating spring 110 (see, e.g. FIG. 7).

A method for operating the slide lock 40 will now be briefly described in the context or scenario of discharging the firearm via a trigger pull in which the slide lock is automatically moved between the locked and unlocked positions via operation of the hammer. When the firearm is in the ready-to-fire position, the bolt slide 40 is in battery with the rear breech end of the barrel 30 and the breech is closed and locked via engagement between the bolt lugs 53 and locking lugs 54 on the barrel extension 32. The slide lock is in the locked position. In one embodiment, the right operating end 104 of the slide lock 40 may be positioned slightly forward of the left actuation end 103 as shown in FIG. 11. The right operating end 104 also projects outward into the ejection port 130 of the upper receiver 21-1 in which the rear facing stepped locking surface 115 of the slide lock is engaged with the forward facing interference surface 108 on the upper receiver 21-1 at the rear of the ejection port 130. The hammer 28 is in the rearward cocked position engaged by the trigger 27, as shown in FIG. 4.

When the trigger 27 is pulled by the user, the catch protrusion 55-2 of trigger 27 disengages the hammer trigger notch 55-1 and releases the hammer which rotates forward thereby striking both the firing pin 50 to detonate the chambered cartridge and the slide lock 100. The rearward facing actuation surface 111 of slide lock is forcibly contacted by the forward facing contact surface 112 of the hammer 28 as it rotates forward about its pivot axis (i.e. pivot pin 113. The slide lock 100 rotates about its pivot axis (i.e. pivot pin 105) to the unlocked position, thereby disengaging the stepped shoulder (i.e. locking surface 115) on the slide lock from the interference surface 108 in the ejection port 130 as the stepped shoulder and right operating end 104 of the slide lock rotates inwards. The breech may now be opened to extract and eject the spent cartridge casing by pulling the pump handle 202 rearward as previously described herein. The hammer 28 is rotated rearward and reset to the cocked position by engagement with the slide when it is drawn rearward in the upper receiver 21-1. When the bolt slide 40 is returned forward and the breech closes, the slide lock 100 re-engages the interference surface 108 on the upper receiver to resume the initial locked position in preparation for the next shot.

According to another aspect, the pump action firearm may further include a manual slide lock release mechanism comprising a depressible manual actuator 120 that operably cooperates and interfaces with the slide lock for manually unlocking the slide. This allows the breech to be opened by the user for removing a chambered cartridge or manually loading a cartridge into the chamber of the barrel. Referring generally to FIGS. 1-3, 7-11, and 19-21, the actuator 120 may be slideably disposed in a lateral opening 129 in the right side of the upper receiver 21-1 proximate to the rear end of the axially elongated ejection port 130 (e.g. just behind it). The actuator body includes an exposed external actuation end 121 and an internal working end 121 positioned to engage the right operating end 104 of the slide lock 100.

The actuation end 121 of actuator 120 may be configured as an oblong button accessible to the user for depressing the actuator 120 inwards to activate the slide lock 100. Actuation end 121 may have a flat body with opposing internal and external major surfaces. The working end 122 may have a extends perpendicularly from the actuation end button and may have an elongated generally cylindrical body. Working end 122 may be terminated with a flat actuation flange 122-1 extending axially from its cylindrical body (see, e.g. FIGS. 19-21). In one embodiment, the working end 122 (e.g. actuation flange 122-1) is engageable with outward facing push surface 116 at the rear end of the right longitudinal section 102 (right operating end 104) of slide lock 100. A vertically oriented retention pin 126 in the upper receiver 21-1 engages an elongated slot retention pin slot 125 formed in the actuator 120 to retain the actuator against the outward biasing force of an operating spring 124 acting on the actuator. The slot 125 may be upwardly, downwardly, and forwardly open in one embodiment as shown; however, in other embodiments the slot may be captive having no portions which extend through the sides of the actuator 120. The body of actuator 120 may be considered generally T-shaped in view of the slot.

The actuator 120 is slideably and laterally (transversely) moveable between an outward deactivated position and an inward activated position. The operating spring 124 biases the actuator outwards towards the deactivated position.

In operation, depressing the actuator 120 inwards engages the working end 122 with the push surface 116 of the right longitudinal section 102 of the slide lock 100. This creates an inwardly directed thrust or pushing force on the operating end 104 of slide lock 100 which rotates the slide lock 100 from the locked position to the unlocked position about pivot pin 105, thereby disengaging the slide lock from the interference surface 108 of the receiver at the ejection port 130, as previously described herein. While continuing to hold the actuator inwards, the pump handle may be manually retracted by the user to open the breech for access to the barrel chamber (to remove a cartridge or hand-load a fresh cartridge into the chamber). When the actuator 120 is released by the user, the operating spring 124 automatically returns the actuator to the outward deactivated position.

It will be appreciated that any of the embodiments and features of the present invention disclosed herein may be used in various combinations with any of the other embodiments and features in various implementations of the invention.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A pump action firearm with bolt slide locking mechanism comprising:

a longitudinal axis;

a receiver defining a longitudinal cavity;

a barrel assembly coupled to the receiver;

a bolt slide slideably disposed in the longitudinal cavity of the receiver, the bolt slide movable between a rearward open breech position and a forward closed breech position in battery with the barrel assembly;

a slide lock pivotably mounted to the bolt slide about a pivot axis and selectively engageable with an interference surface on the receiver, the slide lock pivotably movable between a locked position engaging the interference surface to prevent the slide from moving out of the closed breech position, and an unlocked position disengaging the interference surface to allow the slide to move out of the closed breech position to the open breech position; and a manual actuator slideably mounted to the receiver for transverse movement relative to the longitudinal axis, wherein manually moving the actuator in an inwards direction engages the slide lock and disengages the slide lock from the interference surface of the receiver to unlock the slide lock.

2. The firearm according to claim 1, wherein the pivot axis of the slide lock is vertically oriented perpendicular to the longitudinal axis of the firearm, the slide lock pivotably movable in a horizontal plane between the locked position and the unlocked position.

3. The firearm according to claim 2, wherein the slide lock includes an elongated lateral section arranged transversely across the receiver.

4. The firearm according to claim 3, wherein the lateral section of the slide lock comprises an actuation end on one side of the pivot axis and an operating end on an opposite side of the pivot axis, the operating end configured to engage the interference surface of the receiver when the slide lock is in the locked position, and the actuation end operable to actuate the slide lock.

5. The firearm according to claim 4, wherein the operating end includes a stepped shoulder defining a rear facing locking surface arranged to engage the interference surface of the receiver when the slide lock is in the locked position.

6. The firearm according to claim 5, wherein the locking surface is obliquely angled relative to the longitudinal axis.

7. The firearm according to claim 4, further comprising a spring biasing the operating end forward and the actuation end rearward.

8. The firearm according to claim 4, wherein a body of the slide lock is L-shaped comprising the lateral section, and a longitudinal section extending perpendicularly rearward from the lateral section which collectively defines the operating end with the lateral section.

9. The firearm according to claim 8, wherein the body of the slide lock has a monolithic unitary structure.

10. The firearm according to claim 4, further comprising a rotatable hammer pivotably mounted in the receiver and movable along a longitudinal firing axis between a rear cocked position and a forward firing position, the pivot axis of the slide lock being laterally offset from the firing axis of the hammer.

11. The firearm according to claim 10, wherein when the hammer moves from the rear cocked position to the forward firing position with the slide lock in the locked position, the hammer is arranged to strike the actuation end of the slide lock causing the slide lock to pivot about the pivot axis and disengage the operating end from the interference surface of the receiver.

12. The firearm according to claim 1, wherein the interference surface of the receiver is defined by a laterally open shell ejection port of the receiver.

13. The firearm according to claim 1, further comprising a spring biasing the actuator in an outwards direction from the receiver away from the slide lock.

14. The firearm according to claim 1, wherein the receiver comprises an upper receiver in which the bolt slide and slide lock are disposed, and a lower receiver comprising a firing mechanism, the lower receiver pivotably coupled to the upper receiver.

15. A pump action firearm with bolt slide locking mechanism comprising:

a longitudinal axis;

a receiver defining a longitudinal cavity;

a barrel assembly coupled to the receiver;

a bolt slide slideably disposed in the longitudinal cavity of the receiver, the bolt slide movable between a rearward open breech position and a forward closed breech position in battery with the barrel assembly;

a slide lock pivotably mounted to the bolt slide about a pivot axis and selectively engageable with an interference surface on the receiver, the slide lock pivotably movable between a locked position engaging the interference surface to prevent the slide from moving out of the closed breech position, and an unlocked position disengaging the interference surface to allow the slide to move out of the closed breech position to the open breech position;

wherein the firearm is a pump-action rifle in which the bolt slide is manually movable between the open and closed breech positions by a user via manually sliding a pump handle connected to the bolt slide via a linkage.

16. A pump action firearm with bolt slide lock mechanism comprising:

a longitudinal axis;

a receiver comprising a trigger-actuated firing mechanism including a rotatable hammer movable along a firing axis between a rear cocked position and a forward firing position;

a barrel assembly coupled to the receiver;

a pump handle slideably disposed about the barrel assembly;

a bolt slide slideably disposed in the receiver, the bolt slide coupled to the pump handle and movable between a rearward open breech position and a forward closed breech position in battery with the barrel assembly via moving the pump handle;

a slide lock pivotably mounted to the bolt slide about a pivot axis laterally offset from the firing axis of the hammer;

the slide lock comprising a laterally elongated body including an operating end selectively engageable with an interference surface of the receiver, and an opposite actuation end arranged to engage the hammer;

wherein the slide lock is pivotably movable between a locked position in which the operating end engages the interference surface to prevent the slide from moving out of the closed breech position, and an unlocked position disengaging the interference surface to allow the slide to move out of the closed breech position to the open breech position;

wherein when the hammer moves from the rear cocked position to the forward firing position with the slide lock in the locked position, the hammer strikes the actuation end of the slide lock which rotates about the pivot axis and disengages the operating end from the interference surface to unlock the slide lock.

17. The firearm according to claim 16, wherein the operating end includes a stepped shoulder defining a rear facing locking surface arranged to engage the interference surface of the receiver when the slide lock is in the locked position.

18. The firearm according to claim 17, wherein the locking surface is obliquely angled relative to the longitudinal axis.

19. The firearm according to claim 16, further comprising a spring biasing the operating end forward and the actuation end rearward.

20. The firearm according to claim 16, wherein the body of the slide lock is L-shaped.

21. The firearm according to claim 16, further comprising a manual actuator slideably mounted to the receiver for transverse movement relative to the longitudinal axis, wherein pushing the actuator in an inwards direction engages the slide lock causing it to rotate and disengage the interference surface of the receiver for opening the breech.

22. A pump action firearm with bolt slide lock mechanism comprising:

a longitudinal axis;

a receiver comprising a trigger-actuated firing mechanism including a rotatable hammer movable along a firing axis between a rear cocked position and a forward firing position;

a barrel assembly coupled to the receiver;

a pump handle slideably disposed about the barrel assembly;

a bolt slide slideably disposed in the receiver, the bolt slide coupled to the pump handle and movable between a rearward open breech position and a forward closed breech position in battery with the barrel assembly via moving the pump handle;

a slide lock pivotably mounted to the bolt slide about a pivot axis laterally offset from the firing axis of the hammer;

the slide lock comprising a laterally elongated body including an operating end selectively engageable with an interference surface of the receiver, and an opposite actuation end arranged to engage the hammer;

wherein the slide lock is pivotably movable between a locked position in which the operating end engages the interference surface to prevent the slide from moving out of the closed breech position, and an unlocked position disengaging the interference surface to allow the slide to move out of the closed breech position to the open breech position;

wherein the receiver comprises a lower receiver supporting the hammer and a trigger mechanism operably coupled to the hammer, and an upper receiver pivotably coupled to the lower receiver and slideably supporting the bolt slide.

23. A method for operating an action of a firearm, the method comprising:

providing a firearm comprising a longitudinal axis, a receiver, a barrel assembly coupled to the receiver, a hammer pivotably mounted in the receiver, a bolt slide slideably disposed in the receiver for movement between a rearward open breech position and a forward closed breech position in battery with the barrel assembly, and a slide lock pivotably mounted to the bolt slide about a pivot axis;

engaging an interference surface arranged on the receiver with the slide lock to hold the bolt slide in the closed breech position;

releasing the hammer from a rear cocked position to a forward firing position along a firing axis;

striking the slide lock with the hammer to rotate the slide lock about the its pivot axis;

disengaging the slide lock from the interference surface of the receiver; and moving the bolt slide rearward to the open breech position.

24. The method according to claim 23, wherein the pivot axis of the slide lock is laterally offset from the firing axis of the hammer.

25. The method according to claim 24, wherein the slide lock is L-shaped including a lateral section extending transversely across the receiver and including a pivot pin which defines the pivot axis of the slide lock, and a longitudinal section which defines a locking surface which engages the interference surface on the receiver.

26. The method according to claim 23, wherein the step of moving the bolt slide rearward includes manually moving a pump handle on the firearm coupled to the bolt slide rearward to open the breech.

* * * * *